US009328563B2

(12) United States Patent
Mahajan et al.

(10) Patent No.: US 9,328,563 B2
(45) Date of Patent: May 3, 2016

(54) ADJUSTABLE DIAMETER UNDERREAMER AND METHODS OF USE

(71) Applicant: Smith International, Inc., Houston, TX (US)

(72) Inventors: Manoj D. Mahajan, Houston, TX (US); Sameer P. Bhoite, Conroe, TX (US)

(73) Assignee: Smith International, Inc., Houston, TX (US)

( * ) Notice: Subject to any disclaimer, the term of this patent is extended or adjusted under 35 U.S.C. 154(b) by 381 days.

(21) Appl. No.: 13/798,195

(22) Filed: Mar. 13, 2013

(65) Prior Publication Data

US 2014/0131109 A1 May 15, 2014

Related U.S. Application Data

(60) Provisional application No. 61/725,830, filed on Nov. 13, 2012.

(51) Int. Cl.
*E21B 10/32* (2006.01)
*E21B 23/00* (2006.01)

(52) U.S. Cl.
CPC ..... *E21B 10/322* (2013.01); *E21B 10/325* (2013.01); *E21B 23/006* (2013.01)

(58) Field of Classification Search
CPC ... E21B 10/322; E21B 17/1014; E21B 10/32; E21B 23/006
See application file for complete search history.

(56) References Cited

U.S. PATENT DOCUMENTS

| | | | | |
|---|---|---|---|---|
| 6,708,785 | B1 * | 3/2004 | Russell et al. | 175/321 |
| 6,732,817 | B2 † | 5/2004 | Dewey | |
| 7,681,650 | B2 | 3/2010 | Telfer et al. | |
| 7,891,441 | B2 † | 2/2011 | Lee | |
| 2003/0146023 | A1 * | 8/2003 | Pia | 175/269 |
| 2007/0012440 | A1 † | 1/2007 | Lee | |
| 2007/0107944 | A1 † | 5/2007 | Lee | |
| 2010/0089583 | A1 * | 4/2010 | Xu et al. | 166/298 |

FOREIGN PATENT DOCUMENTS

GB 2460096 A † 11/2009

* cited by examiner
† cited by third party

*Primary Examiner* — Blake Michener
*Assistant Examiner* — Kipp Wallace

(57) ABSTRACT

An underreamer for increasing a diameter of a wellbore. The underreamer includes a body having an axial bore extending at least partially therethrough. An annular sleeve may be coupled to the body and adapted to move with respect to the body. The sleeve may include a plurality of grooves formed therein that are circumferentially offset from one another. A pin may be coupled to the body. The sleeve may be adapted to move with respect to the pin to transition the pin from a first groove in the sleeve to a second groove in the sleeve. The sleeve may be in a first axial position with respect to the body when the pin is positioned in the first groove, and the sleeve may be in a second axial position with respect to the body when the pin is positioned in the second groove. The underreamer also includes one or more cutter blocks. The radial cutting diameter of the one or more cutter blocks depends on the axial position of the one or more cutter blocks and may be determined therefrom.

19 Claims, 3 Drawing Sheets

ADJUSTABLE DIAMETER UNDERREAMER AND METHODS OF USE

CROSS REFERENCE TO RELATED APPLICATIONS

This application claims the benefit of a related U.S. Provisional Application having Ser. No. 61/725,830 filed Nov. 13, 2012, entitled "Adjustable Diameter Underreamer and Methods of Use," to Manoj Mahajan et al., the disclosure of which is incorporated by reference herein in its entirety.

BACKGROUND

Embodiments described herein generally relate to downhole tools. More particularly, such embodiments relate to underreamers and expandable stabilizers for enlarging the diameter of a wellbore.

After a wellbore is drilled, an underreamer is oftentimes used to enlarge the diameter of the wellbore. The underreamer is run into the wellbore in an inactive state. In the inactive state, cutter blocks on the underreamer are folded inwardly toward the body of the underreamer such that the cutter blocks are positioned radially-inward from the surrounding casing or wellbore wall. Once the underreamer reaches the desired depth in the wellbore, the underreamer is actuated in to an active state. In the active state, the cutter blocks move radially-outward and into contact with the wellbore wall. The cutter blocks are then used to increase the diameter of the wellbore.

Conventional underreamers have cutter blocks with a fixed outer diameter when in the active state. As such, conventional underreamers are adapted to create a segment of the wellbore having an increased, but uniform, diameter. It is oftentimes desirable, however, for the wellbore to have varying diameters. For example, cutter blocks become worn down due to excessive vibration in the wellbore. Reducing the diameter of the cutter blocks tends to stabilize the downhole tool, thereby reducing or eliminating wear on the cutter blocks. Currently, this is achieved by pulling the underreamer out of the wellbore to the surface to adjust the outer diameter of the cutting blocks. This delay can lead to lost profits in the field.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An underreamer for increasing a diameter of a wellbore is disclosed. The underreamer includes a body having an axial bore extending at least partially therethrough. An annular sleeve is coupled to the body and adapted to move with respect to the body. The sleeve may include a plurality of grooves formed therein that are circumferentially offset from one another. A pin may be coupled to the body. The sleeve is adapted to move with respect to the pin to transition the pin from a first groove in the sleeve to a second groove in the sleeve. The sleeve is in a first axial position with respect to the body when the pin is positioned in the first groove, and the sleeve is in a second axial position with respect to the body when the pin is positioned in the second groove. A cutter block is coupled to the body. The cutter block moves from a first outer diameter when the sleeve is in the first axial position to a second outer diameter when the sleeve is in the second axial position.

A method for increasing a diameter of a wellbore is also disclosed. The method may include moving an annular sleeve within a body to transition a pin coupled to the body from a first groove in the sleeve to a second groove in the sleeve. The sleeve is in a first axial position with respect to the body when the pin is positioned in the first groove, and the sleeve is in a second axial position with respect to the body when the pin is positioned in the second groove. A cutter block coupled to the body moves from a first outer diameter when the sleeve is in the first axial position to a second outer diameter when the sleeve is in the second axial position. The cutter block increases the diameter of the wellbore.

Another embodiment of an underreamer is further disclosed. The underreamer includes a body having an axial bore extending at least partially therethrough. A cutter block is coupled to the body and adapted to increase the diameter of the wellbore. A linear actuator is coupled to the body. An axial position of the cutter block is determined by a position of the linear actuator, and the cutter block is adapted to move radially outward as the cutter block moves axially.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered limiting of its scope.

DETAILED DESCRIPTION

Figure 1:
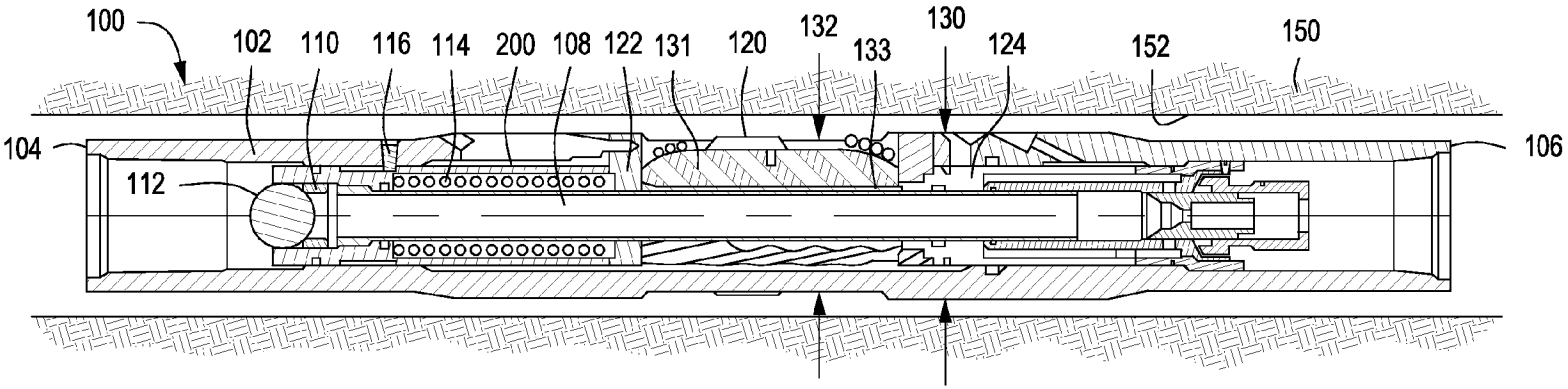
FIG. 1 depicts a cross-sectional view of an illustrative underreamer with a cutter block positioned at a first diameter, according to one or more embodiments disclosed.

FIG. 1 depicts a cross-sectional view of an illustrative underreamer 100 with cutter blocks 120 positioned at a first diameter 132, according to one or more embodiments. The underreamer 100 includes a body 102 having a first or "upper" end portion 104 and a second or "lower" end portion 106. An axial bore 108 extends partially or completely through the body 102.

A ball seat 110 may be disposed within the bore 108. The ball seat 110 may be formed by a transition from a larger inner diameter of the bore 108 to a smaller inner diameter of the bore 108. The ball seat 110 is adapted to receive an impediment, such as a ball 112, that enters the bore 108 through the first end portion 104 thereof. The ball 112 forms a fluid tight seal against the ball seat 110 when fluid pressure is applied to the bore 108 via the first end portion 104 of the bore 108. The ball seat 110, the ball 112, or both may be deformable when exposed to a predetermined fluid pressure in the bore 108. An illustrative ball seat 110 is shown and described in U.S. Pat. No. 7,681,650, the content of which is incorporated by reference to the extent consistent with the present disclosure.

An annular sleeve 200 is disposed within the body 102 and coupled to the ball seat 110. When the ball 112 is received in the ball seat 110, fluid pressure may be applied to the bore 108 from the surface (e.g., via mud pumps). The fluid pressure causes the ball seat 110 and the sleeve 200 to move or stroke in a first axial direction within the body 102, e.g., toward the second end portion 106 of the body 102. Movement of the sleeve 200 in the first axial direction may compress a spring 114. When a predetermined fluid pressure is reached, at least one of the ball seat 110 and the ball 112 may deform to allow the ball 112 to pass through the ball seat 110. When the ball 112 passes through the ball seat 110, the compressed spring 114 causes the ball seat 110 and the sleeve 200 to move or stroke in a second axial direction within the body 102, e.g., toward the first end portion 104 of the body 102. Although FIG. 1 shows the sleeve 200 being moved via the ball seat 110 and the ball 112, it may be appreciated that the sleeve 200 may also be moved by electrohydraulic devices, electromechanical devices, electromagnetic devices, or differential pressure. Differential pressure across the sleeve 200 may be created by employing a flow restrictor (e.g., nozzle or a change in geometry) or by varying a flow rate passing through the bore 108 of the sleeve 200.

Figure 2:
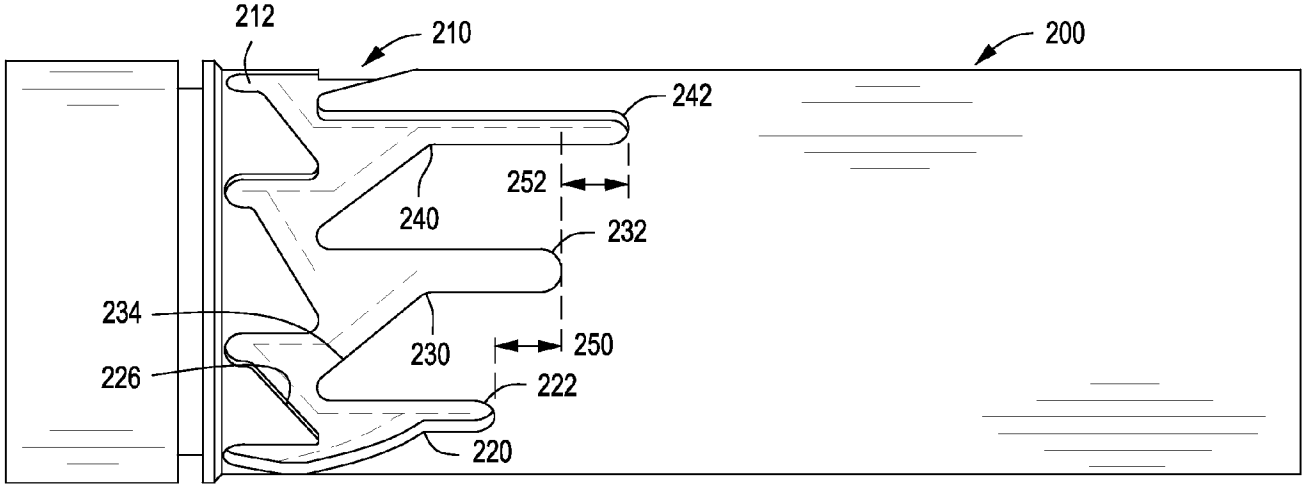
FIG. 2 depicts an illustrative sleeve coupled to the underreamer, according to one or more embodiments disclosed.

FIG. 2 depicts an illustrative sleeve 200, according to one or more embodiments. The sleeve 200 may have an axial bore formed therethrough and have an indexing mechanism 210 coupled thereto or integral therewith. In at least one embodiment, the indexing mechanism 210 includes a plurality of axial grooves (three are shown 220, 230, 240) that are circumferentially offset from one another. The grooves 220, 230, 240 may be formed in an inner or outer surface of the sleeve 200 (or radially-through the sleeve 200). As shown, the indexing mechanism 210 includes a plurality of axial grooves 220, 230, 240 (i.e., an area of reduced outer diameter) formed in the outer surface of the sleeve 200. The grooves 220, 230, 240 are linked together to form a path 212 that extends partially or completely around the circumference of the sleeve 200.

Although three grooves 220, 230, 240 as shown in FIG. 2, it may be appreciated that the number of grooves 220, 230, 240 may range from a low of 1, 2, 3, or 4 to a high of 6, 8, 10, 12, or more. The end portions 222, 232, 242 of the grooves 220, 230, 240 are axially offset from one another. For example, the end portion 222 of the first groove 220 is axially offset from the end portion 232 of the second groove 230 a distance 250, and the end portion 232 of the second groove 230 is axially offset from the end portion 242 of the third groove 240 a distance 252. Although not shown, in at least one embodiment, the end portion 242 of the third groove 240 may be axially aligned with or offset from the end portion 222 of the first groove 220.

Referring now to FIGS. 1 and 2, one or more pins (one is shown 116) may be coupled to (and stationary relative to) the body 102 of the underreamer 100. The pin 116 is disposed within the path 212 of the indexing mechanism 210 in the sleeve 200. As the sleeve 200 moves back and forth, the interaction between the pin 116 and the indexing mechanism 210 causes the sleeve 200 to rotate about a longitudinal axis extending therethrough. For example, the pin 116 may start in the first groove 220. When the sleeve 200 moves in the first axial direction, the pin 116 contacts a first sloped surface 226 of the indexing mechanism 210. The interaction between the pin 116 and the first sloped surface 226 causes the sleeve 200 to rotate partially around the axis of the sleeve 200. When the sleeve 200 moves back in the second axial direction, the pin 116 contacts a second sloped surface 234 of the indexing mechanism 210. The interaction between the pin 116 and the second sloped surface 234 causes the sleeve 200 to rotate further around the axis of the sleeve 200. The second sloped surface 234 guides the pin 116 into the second groove 230. As such, each time the sleeve 200 moves back and forth, the pin 116 transitions between the first groove 220 and the second groove 230, between the second groove 230 and the third groove 240, and so on.

The force applied by the spring 114 causes the pin 116 to be positioned proximate the end portion 222, 232, 242 of the groove 220, 230, 240 after each stroke is complete. In addition, the force applied by one or more cutter blocks also causes the pin 116 to be positioned proximate the end portion 222, 232, 242 of the groove 220, 230, 240 after each stroke is complete, as discussed in more detail below.

The position of the pin 116 in the indexing mechanism 210 determines the axial position of the sleeve 200 with respect to the body 102 of the underreamer 100. For example, as the pin 116 transitions from the end portion 222 of the first groove 220 to the end portion 232 of the second groove 232, the sleeve 200 slides axially toward the first end portion 104 of the body 100 because the second groove 230 is longer than the first groove 220. Similarly, when the pin 116 moves from the end portion 232 of the second groove 230 to the end portion 242 of the third groove 240, the sleeve 200 slides further toward the first end portion 104 of the body 102 because the third groove 240 is longer than the second groove 230. In at least one embodiment, the order and/or length of the grooves 220, 230, 240 may be varied such that the sleeve 200 slides toward the first end portion 104 of the body 102 and/or toward the second end portion 106 of the body 102 by differing distances.

One or more cutter blocks (one is shown 120) is movably coupled to the body 102 of the underreamer 100. Although a single cutter block 120 may be seen in FIG. 1, one or more additional cutter blocks may be circumferentially offset around the body 102. The cutter block 120 may be positioned between the sleeve 200 and the second end portion 106 of the body 102 (as shown). In another embodiment, the cutter block 120 may be positioned between the first end portion 104 of the body 102 and the sleeve 200 (not shown).

The cutter block 120 shown in FIG. 1 is in an inactive state. In the inactive state, the outer diameter of the cutter block 120 ("first diameter 132") is the same as, substantially the same as, or less than the outer diameter 130 of the body 102, and the cutter block 120 is spaced apart from the surrounding casing (not shown) and/or wall 152 of the wellbore 150. An illustrative underreamer 100 having a cutter block 120 coupled thereto is shown and described in U.S. Pat. No. 6,732,817, the content of which is incorporated by reference to the extent consistent with the present disclosure.

Figure 3:
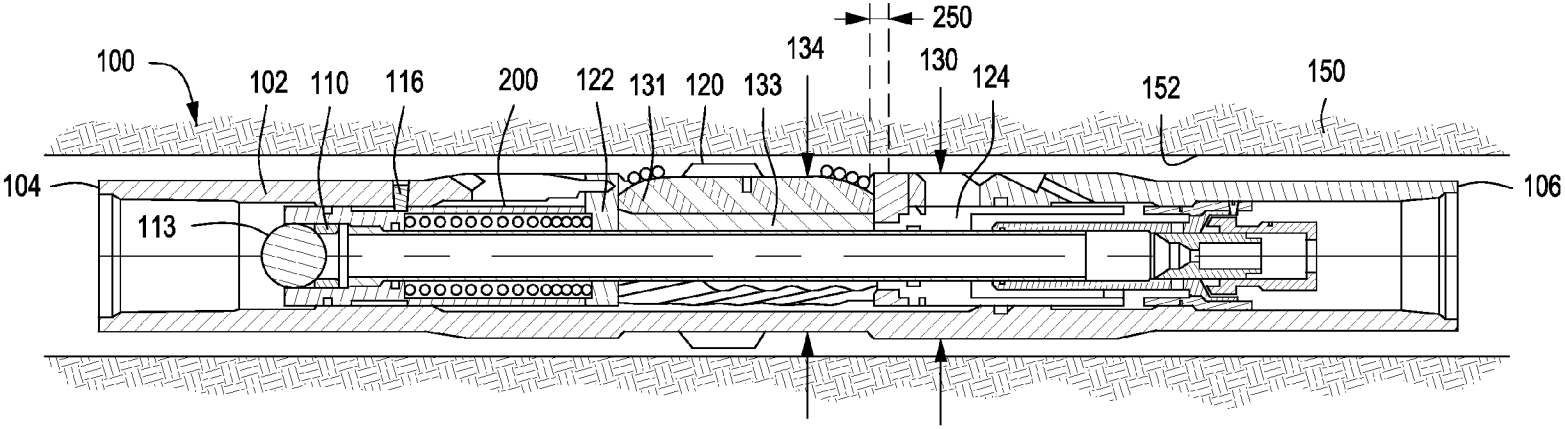
FIG. 3 depicts a cross-sectional view of the underreamer with the cutter block positioned at a second diameter, according to one or more embodiments disclosed.
Figure 4:
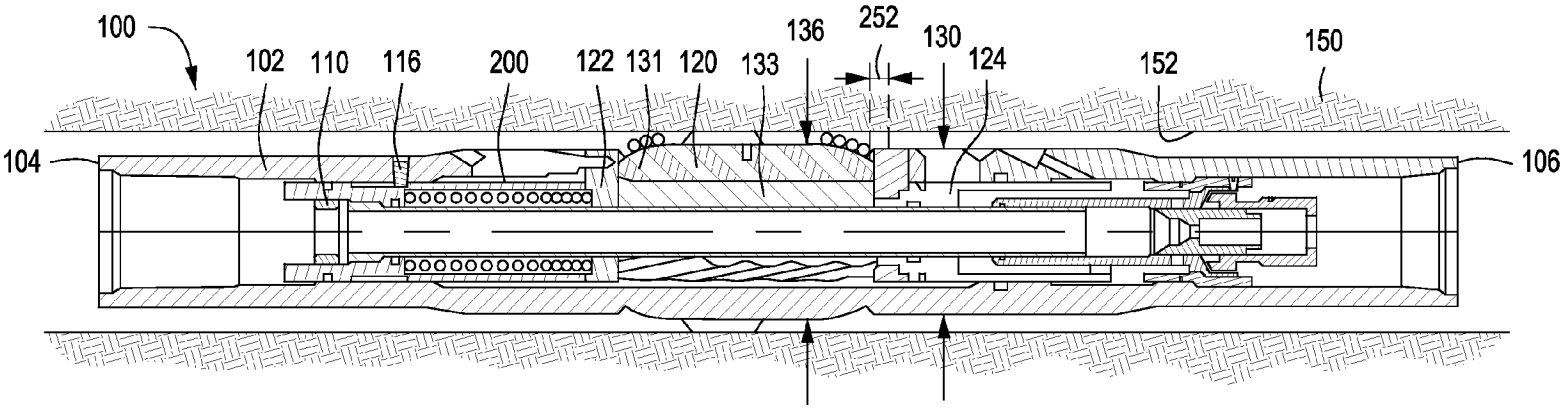
FIG. 4 depicts a cross-sectional view of the underreamer with the cutter block positioned at a third diameter, according to one or more embodiments disclosed.

FIG. 3 depicts a cross-sectional view of the underreamer 100 with the cutter block 120 positioned at a second diameter 134, and FIG. 4 depicts a cross-sectional view of the underreamer 100 with the cutter block 120 positioned at a third diameter 136, according to one or more embodiments. The cutter block 120 is shown in an active state in FIGS. 3 and 4. The underreamer 100 actuates from the inactive state to the active state (or vice versa) while disposed in the wellbore 150. In the active state, the outer diameter 134, 136 of the cutter block 120 is greater than the outer diameter 130 of the body 102. Further, when the cutter block 120 is in the active state, it may be in contact with the wall 152 of the wellbore 150 and adapted to increase the diameter thereof to the outer diameter 134, 136 of the cutter block 120. For example, when the cutter block 120 is set at the second diameter 134, it is adapted to increase the diameter of the wellbore 150 to the second diameter 134, and when the cutter block 120 is set at the third diameter 136, it is adapted to increase the diameter of the wellbore 150 to the third diameter 136.

The cutter block 120 has a plurality of splines 131 disposed or formed on the outer side surfaces thereof. The splines 131 on the cutter block 120 may be or include offset ridges or protrusions adapted to engage and slide within corresponding grooves 133 in the body 102 of the underreamer 100. The splines 131 on the cutter block 120 are oriented at an angle with respect to the longitudinal axis through the body 102 of the underreamer 100. The angle of the splines 131 on the cutter block 120 (and the corresponding grooves 133 in the body 102) may range from a low of about 10°, about 15°, about 20°, or about 25° to a high of about 30°, about 40°, about 50°, about 60°, or more. For example, the angle may be between about 15° and about 25° with respect to the longitudinal axis through the body 102.

When an axial force is exerted on the cutter block 120 in a direction toward the first end portion 104 of the body 102, the engagement of the splines 131 on the cutter block 120 and the grooves 133 in the body 102 causes the cutter block 120 to simultaneously move axially toward the first end portion 104 of the body 102 and radially outward (e.g., between about 15° and about 25° with respect to the longitudinal axis through the body 102). This movement transitions the cutter block 120 from the inactive state (e.g., first diameter 132) to the active state (e.g., second diameter 134 or third diameter 136).

Axial movement of the cutter block 120, however, is limited by the position of the sleeve 200. In other words, when the cutter block 120 contacts the sleeve 200, it is prevented from moving further toward the first end portion 104 of the body 102. When axial movement toward the first end portion 104 of the body 102 is prevented, movement radially outward is also prevented. As such, the outer diameter of the cutter block 120 is determined by the position of the sleeve 200 and, as discussed above, the position of the sleeve 200 is determined by the position of the pin 116 in the indexing mechanism 210.

In operation, the underreamer 100 is run into the wellbore 150 with the cutter block 120 at the first diameter 132 (i.e., in the inactive state), as shown in FIG. 1. The cutter block 120 is maintained at the first diameter 132 via contact with the sleeve 200. More particularly, the sleeve 200 prevents the cutter block 120 from moving axially toward the first end portion 104 of the body 102, which thereby prevents the cutter block 120 from moving radially outward. In at least one embodiment, a stop ring 122 may be disposed between the sleeve 200 and the cutter block 120. The stop ring 122 transmits the axial force from the sleeve 200 to the cutter block 120, or vice versa.

The sleeve 200 is held in place by the interaction between the pin 116 and the indexing mechanism 210. For example, when the pin 116 is positioned proximate the end portion 222 of the first or "shortest" groove 220, the sleeve 200 is secured in a position that maintains the cutter block 120 at the first diameter 132.

To actuate or adjust the cutter block 120 of the underreamer 100 from the first diameter 132, as shown in FIG. 1, to the second diameter 134, as shown in FIG. 3, an impediment (e.g., a ball) 112 is dropped from into the work string (not shown) from the surface. The ball 112 (113 in FIG. 3) travels through the work string and enters the first end portion 104 of the bore 108 of the underreamer 100. The ball 112 is received in the ball seat 110 and forms a fluid tight seal therewith. Fluid pressure is then applied to the bore 108 from the surface. The fluid pressure causes the ball seat 110 and the sleeve 200 coupled thereto to move axially toward the second end portion 106 of the body 102. When the fluid pressure reaches a predetermined level, the ball seat 110, the ball 112, or both may deform to allow the ball 112 to pass through the ball seat 110. When the ball 112 passes through the ball seat 110, the compressed spring 114 causes the ball seat 110 and the sleeve 200 to move back toward the first end portion 104 of the body 102. The ball 112 may be retained in a ball catcher (not shown) position further downhole in the underreamer 100 or pass through the underreamer 100.

As discussed above, movement of the sleeve 200 in an axial direction (i.e., toward the first end portion 104 and/or the second end portion 106 of the body 102) also causes the sleeve 200 to rotate about a longitudinal axis extending therethrough. The axial and rotational movement of the sleeve 200 causes the pin 116 to transition from the end portion 222 of the first groove 220 to the end portion 232 of the second groove 230. When the pin 116 transitions to the end portion 232 of the second groove 230, the sleeve 200 slides axially toward the first end portion 104 of the body 102 a distance 250 due to the increased length of the second groove 230.

Fluid pressure is then applied to the bore 108 from the surface. The fluid pressure in the bore 108 causes a chamber 124 disposed between the cutter block 120 and the second end portion 106 of the body 102 to become pressurized (e.g., by opening a port or valve therebetween). The pressurized chamber 124 exerts a force on the cutter block 120 in a direction toward the first end portion 104 of the body 102. As the sleeve 200 has moved axially toward the first end portion 104 of the body 102 a distance 250, the cutter block 120 may move axially toward the first end portion 104 of the body 102 a distance 250 until it once again contacts the sleeve 200 (or stop ring 122 coupled thereto) preventing further axial movement. The cutter block 120 moves radially outward to the second diameter 134 simultaneously with its movement toward the first end portion 104 of the body 102. When the axial movement is restricted by the sleeve 200, the radial movement is restricted as well, and the cutter block 120 is set at the second diameter 134, as shown in FIG. 3.

Fluid pressure may continue to be applied to the chamber 124 via the bore 108 to maintain the cutter block 120 at the second diameter 134. When the cutter block 120 is at the second diameter 134, it is in the active state and may cut or grind the wall 152 of the wellbore 150 to increase the diameter of a portion of the wellbore 150 to the second diameter 134.

To actuate or adjust the cutter block 120 of the underreamer 100 from the second diameter 134, as shown in FIG. 3, to the third diameter 134, as shown in FIG. 4, the fluid pressure in the bore 108 and the chamber 124 is reduced, which thereby reduces the force exerted on the cutter block 120 toward the first end portion 104 of the body 102. A second ball 113 (see FIG. 3) is then dropped from into the work string (not shown) from the surface. The second ball 113 travels through the work string and enters the first end portion 104 of the bore 108 of the underreamer 100. The second ball 113 is received in the ball seat 110 and forms a fluid tight seal therewith. Fluid pressure is applied to the bore 108 from the surface. The fluid pressure causes the ball seat 110 and the sleeve 200 coupled thereto to move axially toward the second end portion 106 of the body 102. When the fluid pressure reaches a predetermined level, the ball seat 110, the second ball 113, or both may deform to allow the second ball 113 to pass through the ball seat 110. When the second ball 113 passes through the ball seat 110, the compressed spring 114 causes the ball seat 110 and the sleeve 200 to move back toward the first end portion 104 of the body 102. The second ball 113 may be retained in a ball catcher (not shown) positioned further downhole in the underreamer 100 or pass through the underreamer 100.

The axial and rotational movement of the sleeve 200 causes the indexing mechanism 210 to move with respect to the pin 116 such that the pin 116 transitions from the end portion 232 of the second groove 230 to the end portion 242 of the third groove 240. When the pin 116 transitions to the end portion 242 of the third groove 240, the sleeve 200 slides axially toward the first end portion 104 of the body 102 a distance 252 due to the increased length of the third groove 240. The distance 252 may be the same or different than the distance 250.

Fluid pressure is then applied to the bore 108 from the surface. The fluid pressure in the bore 108 causes the chamber 124 to become pressurized. The pressurized chamber 124 exerts a force on the cutter block 120 toward the first end portion 104 of the body 102. As the sleeve 200 has moved axially toward the first end portion 104 of the body 102 a distance 252, the cutter block 120 moves axially toward the first end portion 104 of the body 102 a distance 252 until it once again contacts the sleeve 200 (or stop ring 122 coupled thereto) preventing further axial movement. The cutter block 120 moves radially outward to the third diameter 136 simultaneously with its movement toward the first end portion 104 of the body 102. When the axial movement is restricted by sleeve 200, the radial movement is restricted as well, and the cutter block 120 is set at the third diameter 136, as shown in FIG. 4.

Fluid pressure may continue to be applied to the chamber 124 via the bore 108 to maintain the cutter block 120 at the third diameter 136. When the cutter block 120 is at the third diameter 136, the cutter block 120 is in the active state and may cut or grind the wall 152 of the wellbore 150 to increase the diameter of a portion of the wellbore 150 to the third diameter 136.

To actuate or adjust the cutter block 120 of the underreamer 100 from the third diameter 136, as shown in FIG. 4, to the second diameter 134, as shown in FIG. 3, or to the first diameter 132, as shown in FIG. 1, the fluid pressure in the bore 108 and the chamber 124 is reduced, which thereby reduces the force exerted on the cutter block 120 toward the first end portion 104 of the body 102. A third ball (not shown) is then dropped from into the work string (not shown) from the surface. The third ball travels through the work string and enters the first end portion 104 of the bore 108 of the underreamer 100. The third ball is received in the ball seat 110 and forms a fluid tight seal therewith. Fluid pressure is applied to the bore 108 from the surface. The fluid pressure causes the ball seat 110 and the sleeve 200 coupled thereto to move axially toward the second end portion 106 of the body 102. When the fluid pressure reaches a predetermined level, the ball seat 110, the third ball, or both may deform to allow the third ball to pass through the ball seat 110. When the third ball passes through the ball seat 110, the compressed spring 114 causes the ball seat 110 and the sleeve 200 to move back toward the first end portion 104 of the body 102.

The axial and rotational movement of the sleeve 200 causes the indexing mechanism 210 to move with respect to the pin 116 such that the pin 116 transitions from the end portion 242 of the third groove 240 to the end portion of a fourth groove (not shown). The fourth groove may have a length similar to the first groove 220, the second groove 230, or any other length. When the pin 116 transitions to the end portion of the fourth groove, the sleeve 200 slides axially toward the second end portion 106 of the body 102 a distance 252 (if the fourth groove has a length similar to the second groove 230) or a distance 250+252 (if the fourth groove has a length similar to the first groove 220). When the sleeve 200 slides axially toward the second end portion 106 of the body 102, the sleeve 200 moves the cutter block 120 toward the second end portion 106 of the body 102 a distance 252 (or a distance 250+252). If the cutter block 120 moves toward the second end portion 106 of the body a distance 252, the cutter block 120 simultaneously moves from the third diameter 136 to the second diameter 134. If the cutter block 120 moves toward the second end portion 106 of the body a distance 250+252, the cutter block 120 simultaneously moves from the third diameter 136 to the first diameter 132.

Fluid pressure is then applied to the bore 108 from the surface. The fluid pressure in the bore 108 causes the chamber 124 to become pressurized. The pressurized chamber 124 exerts a force on the cutter block 120 toward the first end portion 104 of the body 102. The fluid pressure may maintain the cutter block 120 at the second diameter 134, or any other diameter depending on the length of the fourth groove.

Therefore, the cutting diameter 132, 134, 136 of the cutter block 120 may be varied while the underreamer 100 is disposed within the wellbore 150. In at least one embodiment, the cutter block 120 may increase the diameter of a first portion of the wellbore 150 to the second diameter 134 and increase the diameter of a second portion of the wellbore 150 to the third diameter 136. In another embodiment, the cutter block 120 may first increase the diameter of a portion of the wellbore 150 to the second diameter 134 and then increase the diameter of the same portion of the wellbore 150 to the third diameter 136.

Figure 5:
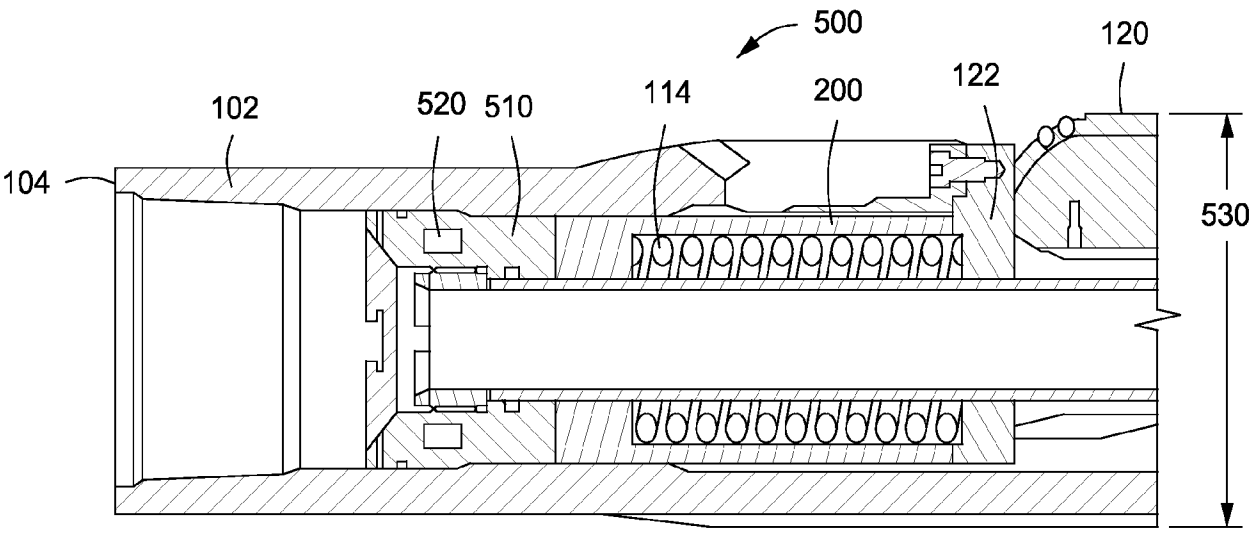
FIG. 5 depicts a partial cross-sectional view of an illustrative underreamer having a linear actuator for restricting the movement of the cutter block, according to one or more embodiments disclosed.

FIG. 5 depicts a partial cross-sectional view of an illustrative underreamer 500 having a linear actuator 510 for restricting the movement of the cutter block 120, according to one or more embodiments. The underreamer 500 shown in FIG. 5 may be similar to the underreamer 100 shown in FIGS. 1, 3, and 4, and like numerals are used to represent like elements. The underreamer 500 may, however, include a linear actuator 510 in addition to, or in place of, the indexing mechanism 210. In at least one embodiment, the linear actuator 510 is positioned between the first end portion 104 of the body 102 and the cutter block 120, as shown.

The linear actuator 510 is adapted to move the sleeve 200 axially to limit the axial and radial movement of the cutter block 120, thereby determining the outer diameter 530 of the cutter block 120 in the same manner as described above. The linear actuator 510 moves the sleeve 200 between two or more predetermined axial positions, and each axial position of the sleeve 200 enables the cutter block 120 to have a different outer diameter 530.

The position (i.e., relative actuation) of the linear actuator 510 indicates and/or signals the axial position of the cutter block 120. As disclosed above, the cutter block 120 moves relative to the body 102 via splines 131 and corresponding grooves 133 in the body 102; therefore, the radial extension of the cutter block 120 relative to the body 102 can then be determined once the axial position of the cutter block is known.

The linear actuator 510 has a control unit 520 coupled thereto or integral therewith. The control unit 520 is adapted to control the movement of the sleeve 200 by the linear actuator 510 in response to a signal received from the surface. The signal may be or include a mud pulse signal, an electromagnetic signal, an electric signal, a hard wire (e.g., intelliserv) magnetic signal, an acoustic signal, a pressure signal, or the like. The linear actuator 510 may also have a power source, e.g., a battery, coupled thereto to power its operation. Such power source may also couple to and power the control unit 520.

Figure 6:
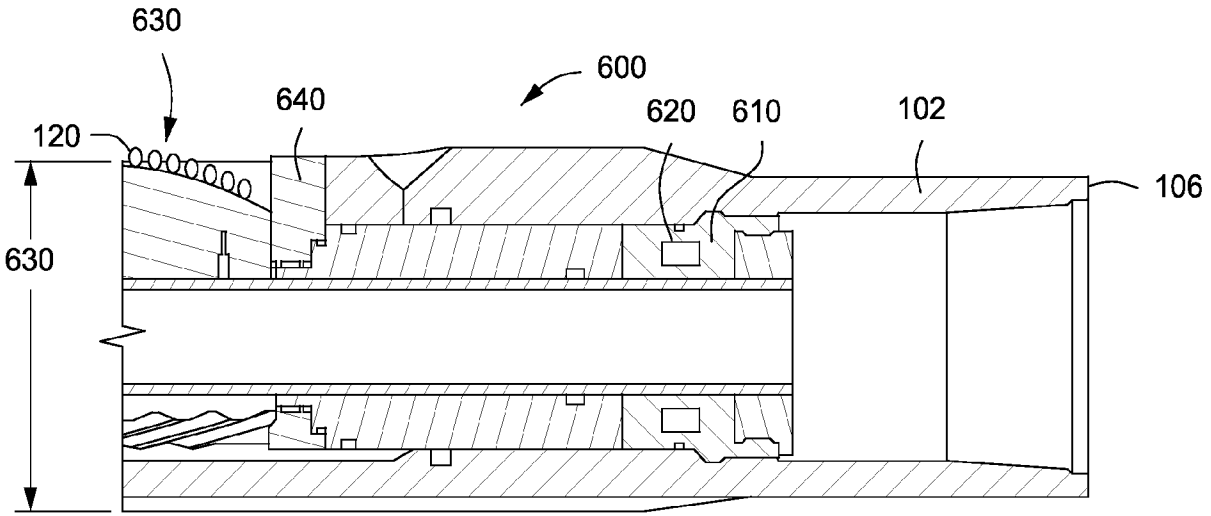
FIG. 6 depicts a partial cross-sectional view of an illustrative underreamer having a linear actuator for moving the cutter block, according to one or more embodiments disclosed.

FIG. 6 depicts a partial cross-sectional view of an illustrative underreamer 600 having a linear actuator 610 for moving the cutter block 120, according to one or more embodiments. The underreamer 600 shown in FIG. 6 may be similar to the underreamers 100, 500 shown in FIGS. 1, 3, 4, and 5, and like numerals are used to represent like elements. In at least one embodiment, the linear actuator 610 is positioned between the cutter block 120 and the second end portion 106 of the body 102, as shown.

Rather than restricting or limiting the movement of the cutter block 120, however, the linear actuator 610 may be adapted to move or push the cutter block 120 toward the first end portion 104 of the body 102, thereby increasing the diameter 630 of the cutter block 120. For example, the linear actuator 610 may move the cutter block 120 between two or more predetermined axial positions, and each axial position of the cutter block 120 may correspond to a different outer diameter 630. In at least one embodiment, a drive ring 640 is disposed between the linear actuator 610 and the cutter block 120 to transmit the force from the linear actuator 610 to the cutter block 120, or vice versa.

The position (i.e., relative actuation) of the linear actuator 610 indicates and/or signals the axial position of the cutter block 120. As disclosed above, the cutter block 120 moves relative to the body 102 via splines 131 and corresponding grooves 133 in the body 102; therefore, the radial extension of the cutter block 120 relative to the body 102 can then be determined once the axial position of the cutter block is known.

The linear actuator 610 has a control unit 620 coupled thereto or integral therewith. The control unit 620 is adapted to control the movement of the linear actuator 610 in response to a signal received from the surface. The signal may be or include a mud pulse signal, an electromagnetic signal, an electric signal, a hard wire (e.g., intelliserv) magnetic signal, an acoustic signal, a pressure signal, or the like. The linear actuator 610 may also have a power source, e.g., a battery, coupled thereto to power its operation. Such power source may also couple to and power the control unit 620.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Although only a few example embodiments have been described in detail above, those skilled in the art will readily appreciate that many modifications are possible in the example embodiments without materially departing from "Adjustable Diameter Underreamer and Methods of Use." Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. An underreamer for increasing a diameter of a wellbore, comprising:

a body having an axial bore extending at least partially therethrough;

a sleeve coupled to the body and adapted to move with respect to the body, wherein the sleeve includes a plurality of grooves and a transition path formed therein, the plurality of grooves being circumferentially offset from one another and extending in a same axial direction away from the transition path and toward respective end portions, and wherein the end portions of at least first, second, and third grooves of the plurality of grooves are axially offset from each other;

a pin coupled to the body, wherein the sleeve is adapted to rotate and move axially with respect to the pin while the pin follows the transition path, and to move only axially while the pin moves away from the transition path while within the first, second, and third grooves, the transition path serving to transition the pin from the first groove to the second groove to the third groove, and wherein the sleeve is in a first axial position with respect to the body when the pin is positioned in the first groove, the sleeve is in a second axial position with respect to the body when the pin is positioned in the second groove, and the sleeve is in a third axial position with respect to the body when the pin is positioned in the third groove; and a cutter block coupled to the body, wherein the cutter block slides outwardly from the axis of the bore from at least a first outer diameter when the sleeve is in the first axial position to a second outer diameter when the sleeve is in the second axial position.

2. The underreamer of claim 1, wherein the first outer diameter is greater than the second outer diameter.

3. The underreamer of claim 1, wherein the first outer diameter is less than the second outer diameter.

4. The underreamer of claim 1, wherein the pin is adapted to transition from the first groove to the second groove when the underreamer is disposed in the wellbore.

5. The underreamer of claim 1, wherein the cutter block moves from the second outer diameter when the sleeve is in the second axial position to a third outer diameter when the sleeve is in the third axial position.

6. The underreamer of claim 1, wherein the sleeve is adapted to move axially with respect to the body and to rotate about a longitudinal axis extending through the sleeve.

7. The underreamer of claim 1, further comprising a seat coupled to the sleeve and adapted to receive an impediment that enters the bore through a first end portion of the body.

8. The underreamer of claim 7, wherein the seat and the sleeve are adapted to move toward a second end portion of the body when the impediment is received in the seat and fluid pressure is applied to the bore.

9. The underreamer of claim 8, wherein at least one of the seat or the impediment is adapted to deform at a predetermined fluid pressure to allow the impediment to pass through the seat.

10. The underreamer of claim 1, wherein the first and second grooves extend axially along the sleeve.

11. The underreamer of claim 1, the transition path of the sleeve including a first angled surface and a second angled surface, the first and second angled surfaces being adapted to transition the pin from the first groove to the second groove.

12. The underreamer of claim 5, wherein:

the first, second, and third axial positions of the sleeve are each different; or the first, second, and third outer diameters of the cutter block are different.

13. The underreamer of claim 1, the first, second, and third grooves extending from the transition path toward a first end of the body.

14. The underreamer of claim 13, the first end of the body being an upper or lower end of the body.

15. An underreamer, comprising:

A body having an axial bore extending at least partially therethrough;

an indexing mechanism coupled to the body, the indexing mechanism including:

a pin;

at least one first groove terminating at a first end portion;

at least one second groove terminating at a second end portion that is axially offset from the first end portion;

at least one third groove extending in a same direction and the at least one first and second grooves and terminating at a third end portion that is axially offset from the first and second end portions;

a plurality of first and second angled surfaces adapted to facilitate movement of the pin between the at least one first and second grooves and between the at least one second and third grooves, wherein the first, second, and third end portions are axially offset in a same direction relative to the plurality of first and second angled surfaces; and a cutter block coupled to the body, wherein the cutter block is adapted be in:

a retracted position when the pin is at the first end portion of the at least one first groove;

a first active position when pin is at the second end portion of the at least one second groove; and a second active position when the pin is at the third end portion of the at least one third groove, wherein the cutter block slides outwardly from the axis of the bore when moving from the first active position to the second active position.

16. The underreamer of claim 15, the plurality of first angled surfaces being angled in a different direction than the plurality of second angled surfaces.

17. The underreamer of claim 15, the indexing mechanism including a sleeve containing the at least one first, second, and third grooves, and the plurality of first and second angled surfaces.

18. The underreamer of claim 15, the at least one first, second, and third grooves extending axially along the sleeve and the plurality of first and second angled surfaces extending at least partially circumferentially along the sleeve.

19. The underreamer of claim 15 , the plurality of first and second angled surfaces being on opposite axial ends of the at least one first, second, and third grooves as are respective, first, second, and third end portions.

* * * * *